US008291769B2

(12) United States Patent
Dobravec

(10) Patent No.: US 8,291,769 B2
(45) Date of Patent: Oct. 23, 2012

(54) MULTIPURPOSE TRANSDUCER FOR AN APPLIANCE USING WATER

(75) Inventor: Klemen Dobravec, Tolmin (SI)

(73) Assignee: Illinois Tool Works Inc., Glenview, IL (US)

( * ) Notice: Subject to any disclaimer, the term of this patent is extended or adjusted under 35 U.S.C. 154(b) by 308 days.

(21) Appl. No.: 12/745,493

(22) PCT Filed: Dec. 29, 2008

(86) PCT No.: PCT/SI2008/000070

§ 371 (c)(1),
(2), (4) Date: Jul. 15, 2010

(87) PCT Pub. No.: WO2009/085019

PCT Pub. Date: Jul. 9, 2009

(65) Prior Publication Data

US 2010/0319461 A1 Dec. 23, 2010

(30) Foreign Application Priority Data

Dec. 28, 2007 (SI) ..... P200700344

(51) Int. Cl.
*G01L 9/04* (2006.01)
*G01N 21/00* (2006.01)

(52) U.S. Cl. ..... 73/726; 73/720; 356/72

(58) Field of Classification Search ..... None
See application file for complete search history.

(56) References Cited

U.S. PATENT DOCUMENTS

| | | | | |
|---|---|---|---|---|
| 5,446,531 | A | 8/1995 | Boyer et al. | |
| 5,603,233 | A | 2/1997 | Erickson et al. | |
| 7,272,960 | B2 | 9/2007 | No et al. | |
| 2003/0227394 | A1 | 12/2003 | Rothgeb et al. | |
| 2004/0007029 | A1 | 1/2004 | Bolduan et al. | |
| 2007/0000784 | A1 * | 1/2007 | Paul et al. | 204/600 |
| 2007/0018652 | A1 | 1/2007 | Broadbent et al. | |
| 2010/0012497 | A1 * | 1/2010 | Neyer et al. | 204/548 |

FOREIGN PATENT DOCUMENTS

| | | | |
|---|---|---|---|
| WO | 0247530 | A | 6/2002 |
| WO | 2005106403 | A2 | 11/2005 |

OTHER PUBLICATIONS

ISR for PCT/SI2008/000070 dated Jul. 8, 2009.

* cited by examiner

*Primary Examiner* — Andre Allen
(74) *Attorney, Agent, or Firm* — Lowe Hauptman Ham & Berner LLP

(57) ABSTRACT

A multipurpose transducer for an appliance using water, like a washing machine, a dishwasher or a hot-water tank converts physical parameters like water temperature, cleanness and pressure in said appliance into electric signals. It is provided with a temperature transducer (TT), a turbidity transducer (TurbT) and a pressure transducer (PT), all of them being fixed on an electrically insulating mounting support (MS). The pressure transducer (PT) is made as an uncompensated strain gauge in a thick film technology. The temperature transducer (TT) made as a termistor is also manufactured in the thick film technology. The multipurpose transducer (MPT) of the invention requires less work steps to be manufactured, mounted and connected in the appliance of said type than earlier transducers.

7 Claims, 1 Drawing Sheet

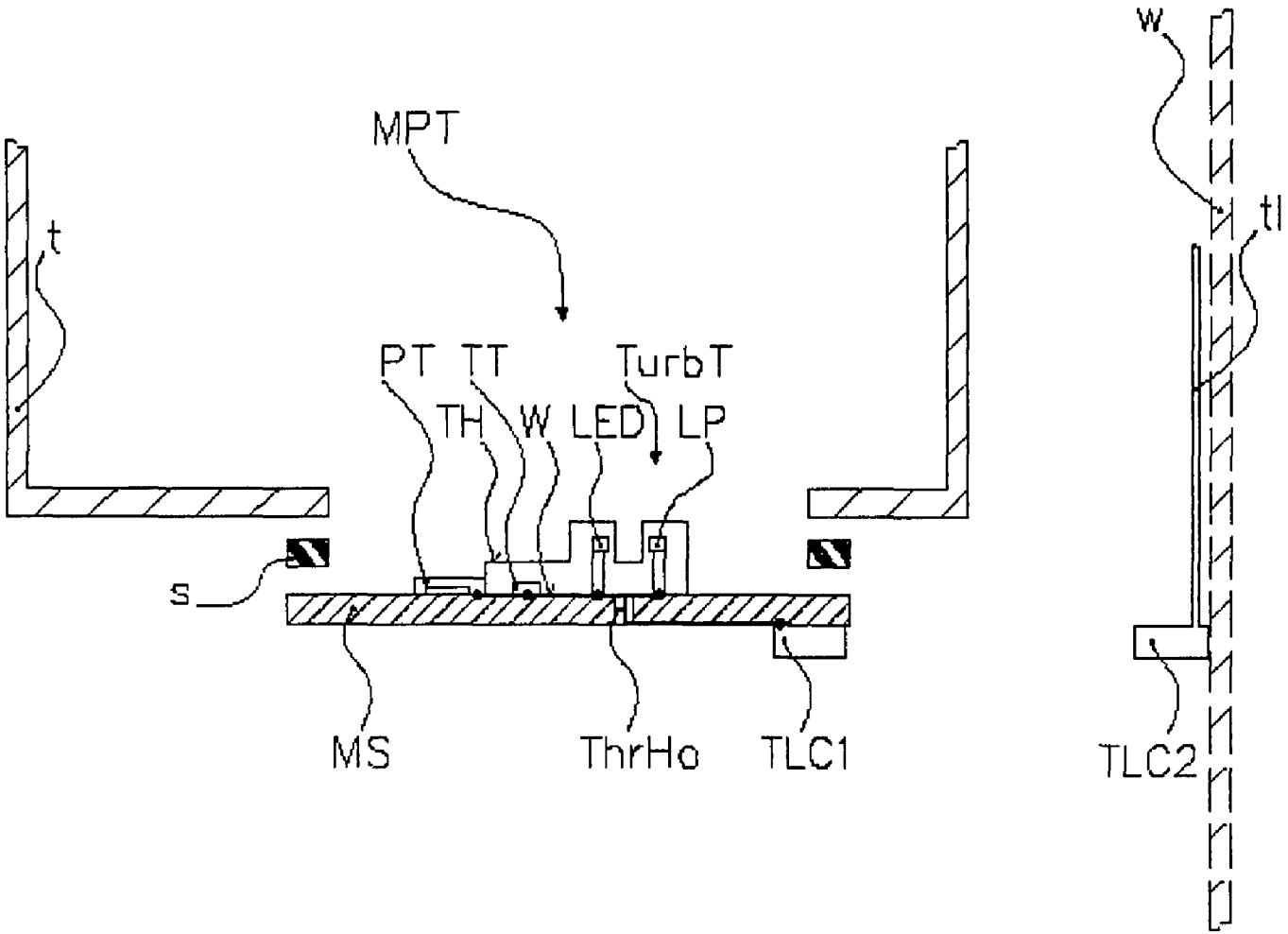
W
tl
TLC2
MPT
PT
TT
TH
W
LED
TurbT
LP
TLC1
ThrHo
MS
S
t

MULTIPURPOSE TRANSDUCER FOR AN APPLIANCE USING WATER

RELATED APPLICATIONS

The present application is national phase of International Application Number PCT/SI/2008/000070, filed Dec. 29, 2008, and claims priority from Slovenian Application Number P200700344, filed Dec. 28, 2007, the disclosures of which are hereby incorporated by reference herein in their entirety.

The invention relates to a multipurpose transducer for an appliance using water, like a washing machine, a dishwasher or a hot-water tank, in fact, in the described application the multipurpose transducer should convert physical parameters, like water temperature, cleanness as well as pressure in said appliance into electric signals.

Transducers are mounted in a known way in a watertight manner and separately from each other in a tank bottom or tank wall of a washing or dishwashing machine, said transducers being foreseen to convert physical parameters of water in the tank during a washing process into electric signals. Normally, these parameters are temperature, turbidity and pressure.

Normally, a simple thermostat switch is used as a temperature transducer in such appliance, said switch detecting that water temperature in the tank of an appliance tank exceeded the preset value during the washing process, whereafter an appliance control circuit switches off heating. The temperature transducer is positioned in an opening in the tank bottom or tank wall in a watertight manner and wired to the appliance control circuit.

Most simply, a turbidity transducer is embodied by a light-emitting diode and a light probe, detecting in an adequately chosen distance from the light-emitting diode, what is the attenuation of the light flux from the light-emitting diode directed to it after having passed through the water in the appliance tank during the washing process, said attenuation being due to the detergent used and dirt particles present in water. If need may be, the turbidity transducer may be provided with another probe detecting in an adequately chosen position, what is the light flux scattered perpendicularly to the direction of the light beam as emitted by the light-emitting diode. The turbidity transducer is placed in an opening in the tank bottom or tank wall in a watertight manner and wired to the appliance control circuit.

A pressure switch is used as a pressure transducer and is placed at the appliance tank and above the highest level of water foreseen in the tank and its pipe is in contact with water in the appliance tank during the washing process by being attached to an opening in the tank bottom or to an outflow system below the tank in a watertight manner. The pressure transducer is wired to the appliance control circuit.

Each of the three mentioned transducers being separated from the two others requires its own watertight fixing construction on the appliance tank and a separate electric connection to the appliance control circuit as well. So each of them needs a separate constructional investment and a separate work effort.

A thermostat switch is normally used as a temperature transducer in a hot-water tank as well, said switch detecting that water temperature in the tank of the appliance exceeded a preset value during the heating process and switches off heating.

U.S. Pat. Nos. 5,446,531 and 5,603,233 owned by Honeywell Inc. disclose a multipurpose transducer for monitoring a condition of water in a washing or dishwashing machine. A transducer cluster senses temperature, turbidity and electrical conductivity of the water in a machine tank during the washing process, and it also senses the movement of a ferromagnetic object attached to a washer arm in the dishwasher. Individual transducers of the cluster are fastened on a first side of an electrically insulating mounting support, which is made as a printed circuit board. On the first side of the insulating mounting support a transparent housing is fastened in a watertight manner covering a temperature transducer made as a thermistor, a turbidity transducer made in a way described above and a transducer for sensing the movement of the ferromagnetic object and a wiring connecting individual transducers to a transmission line. The transmission line provides for energizing the transducers and for a transmission of measuring data herefrom to an appliance control circuit. Said transducer cluster makes it possible to monitor all said variables in any place within the tank of any appliance using water by simply mounting only one single cluster of transducers and the parameter values measured by said transducer cluster are sent to a microcontroller. Said multipurpose transducer certainly reaches a considerable advantage as far as operation of appliances of said type is concerned, however, its disadvantage is apparently in that it still needs a pressure switch separately placed somewhere near and connected that functions as transducer of water pressure in the appliance of said type.

There is known a compact multi-function sensor (WO 2005/106403 A) incorporating a turbidity sensing component, a temperature sensing component and a fluid level (pressure) sensing component mounted on an electrically insulating rigid substrate. The fluid level sensing component comprises a first electric circuit with plurality of first and second thermocouples and a second electric circuit with a heat source raising the temperature of first thermocouples. Drawbacks of said sensor are numerous thermocouples needed. US 2003/227394 A1 discloses a wireless sensor device comprising a sensor component continuously monitoring chemical and/or physical characteristic like pH, conductivity, turbidity, pressure etc. of the surrounding environment, stores and forwards acquired data to an external data collector. US 2007/018652 A1 discloses a miniature planar oceanographic sensor device based on a thin material for sensing conductivity, temperature and pressure of water. A piezoresistive pressure sensor is used.

Based on said deficiency of the currently known multipurpose transducer for monitoring condition of water in an appliance using water, the technical problem of the present invention is how to construct a multipurpose transducer that will comprise a pressure transducer foreseen to be in contact with the water present within an appliance tank.

The invention will now be explained in more detail by way of the description of an embodiment and its variant as well with reference to the accompanying drawing representing in FIG. 1 schematically, the multipurpose transducer of the invention for monitoring condition of water in an appliance using water and its fixing to the tank bottom of said appliance.

A multipurpose transducer MPT of the invention is intended for an appliance using water within a tank t (FIG. 1).

The multipurpose transducer MPT is provided with a temperature transducer TT and a turbidity transducer TurbT, both being fixed on a first side of an electrically insulating mounting support MS. This side of the mounting support MS is pressed against an outer tank surface at the bottom of the tank t using a seal s and a fixing means—not represented in FIG. 1.

On a first part of said first side of the mounting support MS a transparent housing TH is fixed in a watertight manner. The transparent housing TH covers the temperature transducer TT and the turbidity transducer TurbT as well as a wiring W conducted to them along the mounting support MS.

The turbidity transducer TurbT is embodied in a known way by means of a light-emitting diode LED and a light probe LP, the latter detecting, what is the attenuation of the light beam emitted by the light-emitting diode LED and directed to the light probe LP after having passed the water in the appliance tank during the washing process. Said attenuation is a consequence of a detergent and dirt particles present in water.

The multipurpose transducer MPT is provided according to the invention with a pressure transducer PT as well. The pressure transducer PT is fixed on that part of said first side of the mounting support MS, which is not covered by the transparent housing TH. The covered wiring W connects also the pressure transducer PT to a first transmission-line coupler TLC1.

The invention also proposes that the pressure transducer PT should be made as an uncompensated strain gauge. An uncompensated strain gauge is preferably applied, which is manufactured in a thick film technology, e.g. by HYB d.o.o. from Slovenia (www.hyb.si).

In a known way, the temperature transducer TT is made as a termistor and, yet the present invention proposes manufacturing in thick film technology, e.g. by HYB d.o.o. from Slovenia.

The electrically insulating mounting support MS is preferably made as a ceramic plate.

Less work steps are needed for the multipurpose transducer MPT of the invention to be manufactured, mounted and connected in the appliance of said type than for the corresponding transducer cluster used so far. This estimate derives from the known multipurpose transducer, additionally to which also a pressure switch must be mounted near the appliance tank and whose pipe is in contact with the water in the tank. The pressure switch is still mounted and is foreseen to be mounted in the future as well (US 2004/0007029 A1, U.S. Pat. No. 7,272,960 B2).

On one of other sides of the electrically insulating mounting support MS, the first transmission-line coupler TLC1 is fixed, whereto the wirring W is conducted, e.g. passing a through hole ThrHo made through the mounting support MS.

A second transmission-line coupler TLC2 connected to the control circuit—not represented—of the appliance using water through a transmission line tl is fastened to a wall w of the appliance or to a wall w supporting the appliance in the case of a hot-water tank.

The transmission-line couplers TLC1 and TLC2 may be embodied as connector plug adapters, which are connected to each other by a multiwire cable provided with connector plugs.

The invention further proposes the following variant embodiment. The first transmission-line coupler TLC1 is made as a transponder in a radio frequency identification system and the second transmission-line coupler TLC2 is carried out as an interrogator in the same radio frequency identification system.

The first transmission-line coupler TLC1 may be made as a passive or an active transponder in the radio frequency identification system. In the latter case, the transponder is energized by a battery having an operating life time up to ten years.

A still further simplification and a decrease in price of the connection are achieved by the multipurpose transducer of the invention which uses the transponder and the interrogator in the radio frequency identification system to communicate with the appliance control circuit.

The invention claimed is:

1. Multipurpose transducer (MPT) for an appliance using water, the multipurpose transducer (MPT) being provided with a temperature transducer (TT) and a turbidity transducer (TurbT), which are fixed on a first side of an electrically insulating mounting support (MS), on whose first part of said first side a transparent housing (TH) is fixed in a watertight manner, and with a pressure transducer (PT) fixed on said first side of the electrically insulating mounting support (MS), said transparent housing (TH) covering the temperature transducer (TT) and the turbidity transducer (TurbT) and a wiring (W) to them made on the mounting support (MS), and on one of its other sides of which a first transmission-line coupler (TLC1) is fixed, whereto the wining (W) is conducted, characterized in that the pressure transducer (PT) is an uncompensated strain gauge, that the pressure transducer (PT) is fixed on a second part of said first side of the mounting support (MS)

and that the wirring (W) connects the pressure transducer (PT) to the first transmission-line coupler (TLC1).

2. Multipurpose transducer (MPT) for the appliance using water as recited in claim 1, characterized in that the pressure transducer (PT) made as the uncompensated strain gauge is manufactured in a thick film technology.

3. Multipurpose transducer (MPT) for the appliance using water as recited in claim 1, characterized in that the temperature transducer (TT) made as a termistor is manufactured in the thick film technology.

4. Multipurpose transducer (MPT) for the appliance using water as recited in claim 1, characterized in that the first transmission-line coupler (TLC1) is made as a transponder in a radio frequency identification system and that a second transmission-line coupler (TLC2) connected to a control circuit of the appliance using water through a transmission line (t1), is carried out as an interrogator in the same radio frequency identification system.

5. Multipurpose transducer (MPT) for the appliance using water as recited in claim 4, characterized in that the first transmission-line coupler (TLC1) is made as a passive transponder in the radio frequency identification system.

6. Multipurpose transducer (MPT) for the appliance using water as recited in claim 4, characterized in that the first transmission-line coupler (TLC1) is made as an active transponder in the radio frequency identification system.

7. Multipurpose transducer (MPT) for the appliance using water as recited in claim 4, characterized in that the electrically insulating mounting support (MS) is made as a ceramic plate.

* * * * *